US006148585A

United States Patent [19]

Baker

[11] Patent Number: 6,148,585

[45] Date of Patent: Nov. 21, 2000

[54] ARCHITECTURAL COLUMN COVER AND WALL PANEL ASSEMBLY

[75] Inventor: Robert F. Baker, Dallas, Tex.

[73] Assignee: Baker Metal Products Inc., Dallas, Tex.

[21] Appl. No.: 09/229,369

[22] Filed: Jan. 13, 1999

[51] Int. Cl.[7] ..... E04C 3/30

[52] U.S. Cl. ..... 52/737.4; 52/36.6; 52/489.1; 52/506.05; 52/585.1; 52/712; 52/736.3; 52/738.1

[58] Field of Search ..... 52/36.6, 489.1, 52/506.05, 585.1, 712, 736.3, 737.4, 738.1, 506.06

[56] References Cited

U.S. PATENT DOCUMENTS

| | | | |
|---|---|---|---|
| 1,231,289 | 6/1917 | Otte . | |
| 2,881,877 | 4/1959 | Olsen . | |
| 3,103,708 | 9/1963 | Pomeroy et al. . | |
| 3,196,495 | 7/1965 | Owen . | |
| 3,722,163 | 3/1973 | Satkin et al. . | |
| 4,034,535 | 7/1977 | Dustmann . | |
| 4,060,294 | 11/1977 | Haworth et al. . | |
| 4,428,172 | 1/1984 | Larsson . | |
| 4,509,246 | 4/1985 | Fischer et al. . | |
| 4,606,167 | 8/1986 | Thorne . | |
| 4,704,835 | 11/1987 | Jordan . | |
| 4,845,912 | 7/1989 | Baker . | |
| 4,905,334 | 3/1990 | Oppenhuizen . | |
| 5,054,255 | 10/1991 | Maninfior . | |
| 5,063,715 | 11/1991 | Goodman . | |
| 5,561,960 | 10/1996 | Minnick et al. . | |
| 5,953,878 | 9/1999 | Johnson | 52/582.2 |
| 6,009,683 | 1/2000 | Grewe et al. | 52/721.4 |

*Primary Examiner*—Christopher T. Kent
*Attorney, Agent, or Firm*—Fitzpatrick, Cella, Harper & Scinto

[57] ABSTRACT

An architectural assembly comprising a plurality of panels and a plurality of hooking members. The hooking members are in locked engagement with longitudinal edges of the panels, and fixedly couple together these panels. The panels may be semi-circular in shape, and, when coupled together, collectively form a circular structure that may be used to surround a structural column. In another embodiment of the invention, a panel attachment assembly is provided, comprising a plurality of supporting members mounted to a fixed structure, at least one panel, and the hooking members. The hooking members are lockingly engaged with the panel and the supporting members, for fixedly securing the panel to the supporting members. The hooking members preferably comprise a U-shaped portion having a base portion and two projecting portions extending from opposite sides of the base portion. The hooking members also comprise head and tail portions extending from upper and lower surfaces, respectively, of the base portion. One projecting portion and the tail portion are separated by a first gap, and the other projecting portion and the tail portion are separated by a second gap. As such, the hooking members may be used advantageously to couple panel segments having either a first or second thickness.

25 Claims, 8 Drawing Sheets

ARCHITECTURAL COLUMN COVER AND WALL PANEL ASSEMBLY

BACKGROUND OF THE INVENTION

The present invention relates to architectural accent assemblies and more particularly to panels which are used to cover fixed structures such as the sides of buildings and support columns or the like.

Present day architectural standards require that the support structures for multi-floored buildings must be covered to provide an aesthetically appealing external appearance. The requisite appearance is generally obtained by using panels that may be flat, circular or oval shaped.

Methods and apparatus for attaching such panels to a support column have taken many forms. In one such arrangement, the abutting longitudinal edges of adjacent panel segments are bent at right angles toward the support structure. One of the segments is fastened directly to the column while being provided with a clip on its right-angled face, such clip having an upwardly facing hook thereon. The right-angled face of the other panel segment is provided with a slot into which the hook is received, so that the slotted panel segment is hung on the clip-bearing panel segment, which in turn is fixed to the support structure.

Another method and apparatus for joining two sections of a cover assembly uses a turn bolt type of arrangement. Again, the panel segments have right-angle faces which provide longitudinal flanges. Each panel segment has an elongated hole in its flange, and adjacent flanges are positioned with a space therebetween. A pivoting T-shaped clip is inserted in between the panels and rotated to engage each of the panels through the elongated holes. Brackets are fastened to the support structure and the T-shaped clips are then tightened to the brackets by set screws.

A third method and apparatus for joining two cover panel segments includes a keyhole slot type of arrangement. The panel segments are provided with flanges as described above and a screw extends from one flange. The screw has a head with a diameter larger than that of its shank. A slot, in the shape of an inverted keyhole, is provided on the flange of a second segment of the cover for receiving the screw head in a known manner within the large part of the slot. The slotted panel is then lowered so that the narrow portion of the slot engages the shank of the screw.

Each of these arrangements have similar problems in permitting accurate alignment and easy mounting of the panels. In the keyhole slot arrangement, a further problem is encountered in the play which results when the screw does not have the exact length necessary to permit a snug engagement of the flange of the second section. When the screw head does not extend far enough, the cover cannot be set in place, and when it extends too far, the cover remains loosely attached and may vibrate or rattle with any movement of the structure to which it is attached.

A fourth type of arrangement for attaching aesthetically pleasing covers on support structures is one which uses industrial strength velcro. This type of arrangement is extremely expensive and requires a high level of precision for proper positioning of the various portions of the covers. In this method, velcro is attached along the lengths of the support structures and covers, and the cover sections are then pressed in place on the support structure. Once the two elements are joined, they must be separated completely in order to correct any misalignment. Also, since the cover and structure do not securely lock together, an additional force is required to ensure permanent mating.

In another type of known arrangement in which the sections of column covers are set in place, a two step joining procedure is required. A bracket having slots arranged for enveloping flanges is fixed to the permanent structure. The cover panels have flanges which bend around to provide an abbreviated surface parallel to the main surface of the covering, and the slots on the brackets are configured to receive those abbreviated surfaces. A space is provided between the panels and a plug is inserted in that space for holding the portions of the cover in place. While this type of assembly simplifies installation it leaves a wide gap between sections of a column cover. Furthermore, additional assembly time is required for the multi-step procedure.

All of the foregoing structures require a high degree of accuracy and precision in aligning two sections of the architectural coverings, both in the horizontal and vertical directions, while failing to provide a desirable degree of strength. These difficulties provide for increased installation expenses and undesirable final results.

SUMMARY OF THE INVENTION

Therefore, it is an object of the invention to provide a column cover assembly and a wall panel assembly which may be installed easily and quickly. An additional object of the invention is to provide these assemblies with self aligning features.

The present invention satisfies these objects and provides a solution to the problems of the prior art arrangements by providing a column cover assembly and a wall panel assembly, both providing a unique engaging mechanism, hereinafter referred to as a hooking member, for fixedly coupling together components of these respective assemblies. In accordance with one embodiment of the invention, the column cover assembly comprises a first semi-circular panel, a second semi-circular panel, and a plurality of the hooking members. A plurality of vertically aligned slots are provided in longitudinal edges of each of the first and second semi-circular panels, and the hooking members are engaged with the longitudinal edges of the first and second semi-circular panels through these slots. In this manner, the hooking members fixedly couple the first and second semi-circular panels, and these panels thereby form a substantially circular structure which may be employed to surround, for example, a structural column.

In accordance with an embodiment of the wall panel assembly of the invention, the wall panel assembly comprises one or more wall panels, the plurality of hooking members, and a plurality of supporting members that are mounted to a fixed structure, such as a wall or a structural column of a building. The supporting members are preferably mounted such that slots of the supporting members align with corresponding slots of a rear portion of the wall panels. The plurality of hooking members engage with the wall panels and supporting members through these slots, for fixedly securing the panels to the supporting members.

The hooking members preferably comprise an inverted U-shaped portion, a head portion, and a tail portion. The U-shaped portion includes a base portion and first and second projecting portions that extend downwardly from opposite sides of the base portion. The head portion extends from an upper surface of the base portion, and the tail portion extends from a lower surface of the base portion. In accordance with an important aspect of this invention, the first projecting portion and the tail portion are separated by a first distance, and the second projecting portion and the tail portion are separated by a second, greater distance.

Accordingly, panel segments having one thickness may be received between the first projecting portion and the tail portion, and panel segments having another thickness may be received between the second projecting portion and the tail portion.

BRIEF DESCRIPTION OF THE DRAWINGS

The above set forth and other features of the invention are made more apparent in the ensuing Detailed Description of the Invention when read in conjunction with the attached Drawings, wherein.

Identical portions of the various figures have been identified with the same reference numerals in order to simplify the description of the present invention. Components having similar purposes have been designated using the same reference numerals with a prime or double prime added.

DETAILED DESCRIPTION OF THE INVENTION

Figure 1:
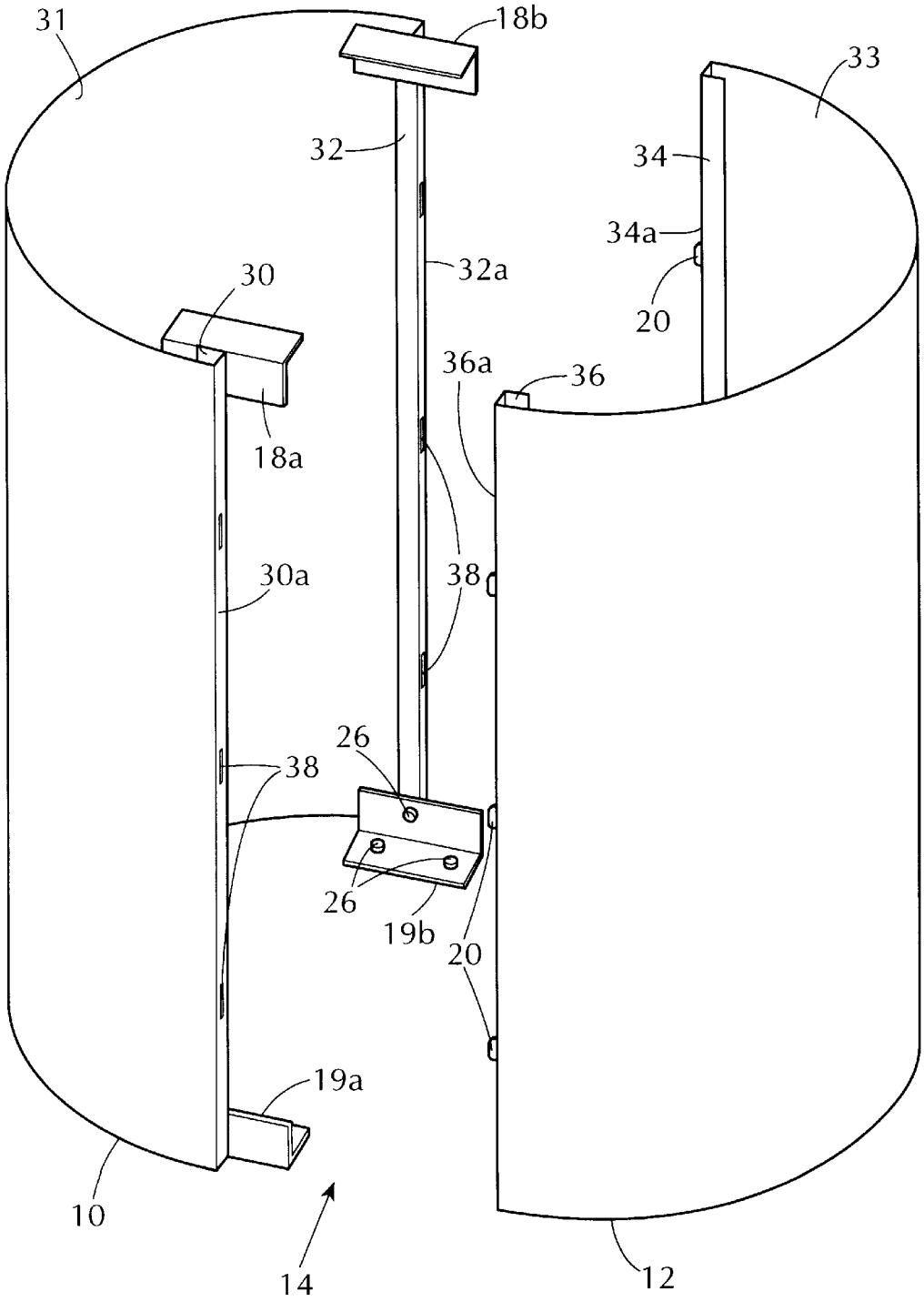
FIG. 1 is a perspective view of an architectural column cover assembly of this invention, the column cover assembly having two semi-circular sections that are depicted as being disassembled.

FIG. 1 illustrates two semi-circular sections 10 and 12 of a disassembled column cover assembly (also referred to simply as a "column cover") 14, the semi-circular sections 10 and 12 being constructed in accordance with the present invention. In a preferred embodiment of the invention, the semi-circular section 10 has flanges 30 and 32, which may be formed by double right angle bends in opposing longitudinal edges of the semi-circular section 10. Accordingly, the flanges 30 and 32 each extend in parallel with an adjacent portion of an inner surface 31 of the semi-circular section 10. Also in accordance with the preferred embodiment of the invention, the semi-circular section 12 has flanges 34 and 36, which may be formed by double right angle bends in opposing longitudinal edges of the semi-circular section 12. Each of these flanges 34 and 36 extends in parallel with an adjacent portion of an inner 33 surface of the semi-circular section 12.

A plurality of longitudinally aligned slots 38 are provided at predetermined intervals in a face portion 30*a,* 32*a,* 34*a,* and 36*a* of the respective flanges 30, 32, 34, and 36. Each slot 38 may have dimensions of approximately 5/16 inches× 1½ inches, although other suitable dimensions may also be employed. Adjacent slots 38 in each face portion 30*a,* 32*a,* 34*a,* and 36*a* are preferably separated by an identical distance such that, when the semi-circular portions 10 and 12 are brought together so that the face portions 30*a* and 32*a* abut the respective face portions 36*a* and 34*a* (so as to form the circular column cover 14), the slots 38 from the face portions 30*a* and 36*a* are substantially aligned with one another, and the slots 38 from the face portions 32*a* and 34*a* are also substantially aligned with one another.

Figure 2:
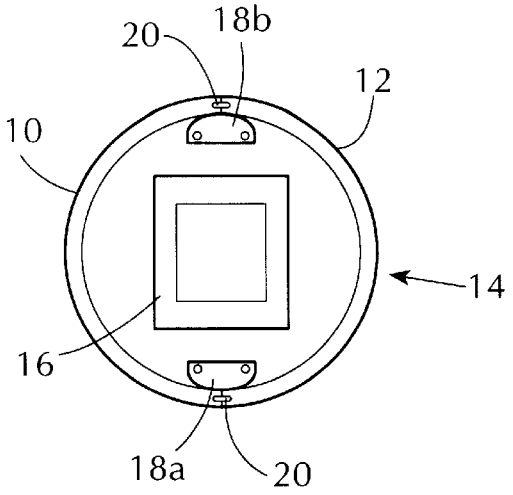
FIG. 2 represents a cross section of the column cover assembly of FIG. 1, wherein the semi-circular sections are shown as being assembled around a structural column, and wherein these components are viewed from a perspective looking down on the components.
Figure 5:
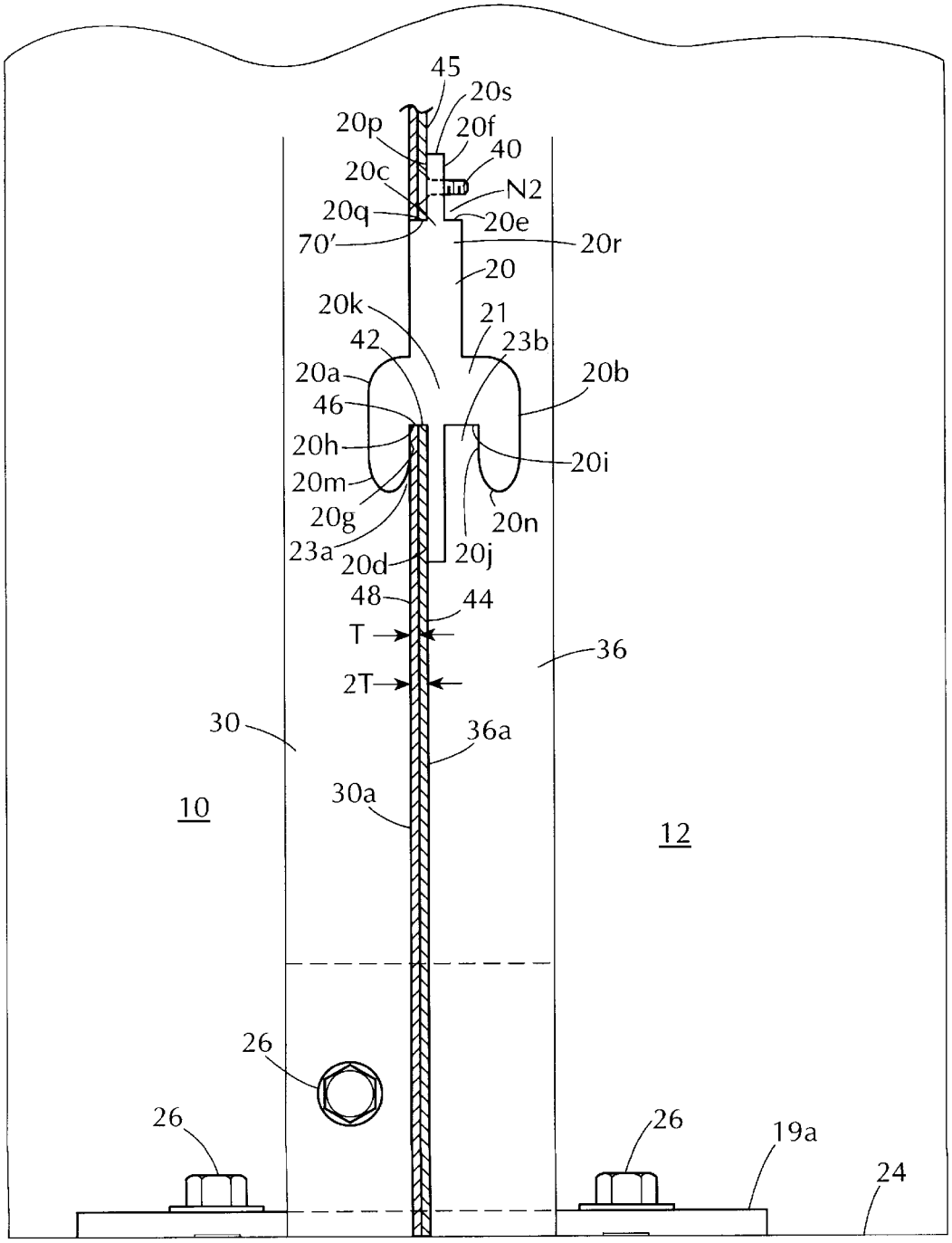
FIG. 5 shows portions of semi-circular sections of the column cover assembly of FIG. 1, and also shows a hooking member of the invention engaged with these semi-circular sections.
Figure 6:
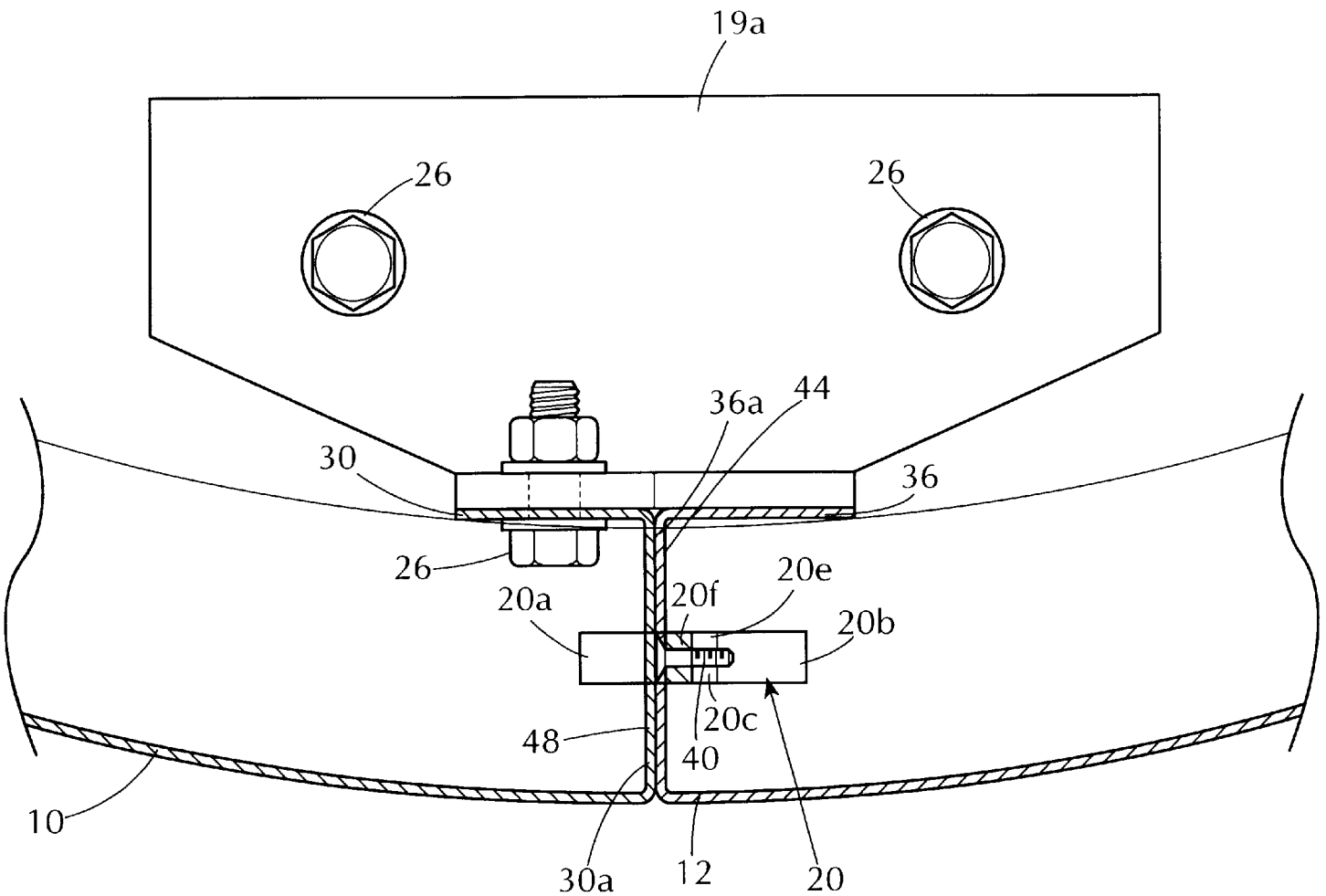
FIG. 6 shows the portions of the semi-circular sections and the hooking member of FIG. 5, as viewed from a perspective looking down on these components.

Before describing the manner in which the semi-circular sections 10 and 12 are joined together, an aspect of the invention relating to the manner in which semi-circular section 10 may be mounted to a fixed structure will first be described. Referring to FIG. 2, a structural column 16 is shown as being generally square in shape, although fixed structures having other shapes may also be used in conjunction with this invention. Referring also to FIGS. 1, 5, and 6, a first pair and a second pair of angled anchor members 18*a,* 18*b* and 19*a,* 19*b,* respectively, may be employed for mounting a semi-circular section 10 to one or more fixed surfaces, such as a floor and/or ceiling of a building. The components 18*a,* 18*b,* 19*a,* and 19*b* may be mounted to the semi-circular section 10 and the fixed surfaces by means of, for example, screws 26, although other suitable mounting mechanisms may also be employed. One or more of the semi-circular sections 10 and 12 may also be mounted to the structural column 16 using a suitable mounting mechanism, such as, for example, screws and mounting plates. Also, it should be noted that the semi-circular sections 10 and 12 may be free-standing, and need not surround a structural column 16.

Figure 3A:
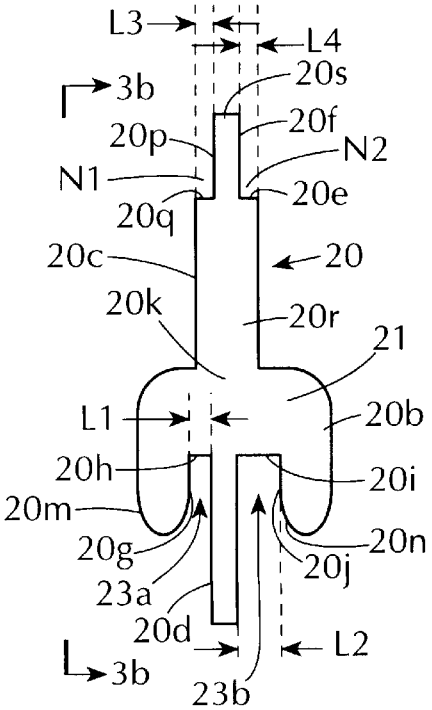
FIG. 3*a* shows a hooking member that is constructed in accordance with this invention.
Figure 3B:
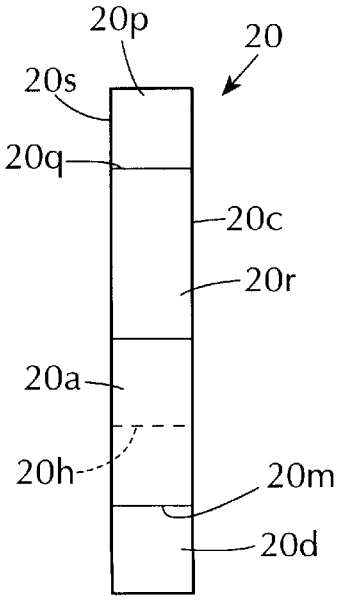
FIG. 3*b* is a sectional view taken in a plane 3*b*—3*b* of FIG. 3*a;*

Referring now to FIGS. 3*a* and 3*b,* a hooking member 20 that is constructed in accordance with this invention will now be described. The hooking member 20 comprises an inverted U-shaped portion 21, a panel engaging head portion 20*c,* and a panel engaging tail portion 20*d.* The panel engaging tail portion 20*d* extends downwardly from a lower surface of a base portion 20*k* of the U-shaped portion 21. The panel engaging head portion 20*c* includes a lower head portion 20*r* which extends upwardly from an upper surface of the base portion 20*k,* and also includes an upper head portion 20*s.* The upper head portion 20*s* extends upwardly from an upper surface of the lower head portion 20*r,* and is narrower in width relative to the lower head portion 20*r.* Surface portions 20*q* and 20*e,* which form portions of the upper surface of lower head portion 20*r,* preferably extend along a same plane, but from opposing sides of the upper head portion 20*s.* The surface portion 20*q* of the lower head portion 20*r* and a side surface 20*p* of the upper head portion

20*s* preferably form a right angle, and thus a first angled notch N1 is provided on one side of the head portion 20*c*. Similarly, the surface portion 20*e* of the lower head portion 20*r* and a side surface 20*f* of the upper head portion 20*s* also preferably form a right angle for providing a second angled notch N2 on the opposite side of the head portion 20*c*. The upper head portion 20*s* and the tail portion 20*d* preferably lie in a same plane, and share a common center axis.

In addition to the base portion 20*k*, the U-shaped portion 21 also comprises first and second panel engaging portions 20*a* and 20*b* (also referred to as first and second projections), respectively, which extend downwardly from opposite sides of the base portion 20*k*. Preferably, a locking surface 20*g* of the first panel engaging portion 20*a* and a support surface 20*h* of the base portion 20*k* form a right angle, and a locking surface 20*j* of the second panel engaging portion 20*b* and a support surface 20*i* of the base portion 20*k* also form a right angle. The locking surface 20*g* terminates in a substantially rounded surface 20*m* at a lower end of the first panel engaging portion 20*a*, and the locking surface 20*j* also terminates in a substantially rounded surface 20*n* at a lower end of the second panel engaging portion 20*b*.

In accordance with an aspect of this invention, and referring in particular to FIG. 3*a*, the support surface 20*h* of the first panel engaging portion 20*a* preferably has a first length (L1) (e.g., ⅛") which is great enough for enabling components (e.g., two abutting panel segments) having a first thickness (e.g., each panel segment having a thickness of 1/16") to be received in a first gap 23*a* between the locking surface 20*g* and the panel engaging tail portion 20*d*. Also, the support surface 20*i* of the second panel engaging portion 20*b* preferably has a second, greater length (L2) (e.g., ¼") which is sufficient for enabling components (e.g., two abutting panel segments) having a second, greater thickness (e.g., each panel segment having a thickness of ⅛") to be received in a second gap 23*b* between the locking surface 20*j* and the panel engaging tail portion 20*d*. Moreover, the upper surface portion 20*q* of the lower head portion 20*r* preferably has a length (L3) (e.g., 1/16") which is equivalent to approximately one-half of the length (L1) of support surface 20*h*, and the upper surface portion 20*e* of the lower head portion 20*r* preferably has a length (L4) (e.g., ⅛") which is equivalent to approximately one-half of the length (L2) of support surface 20*i*.

The hooking member 20 is preferably fabricated by extruding or casting aluminum, plastic, or some other suitable material. Preferably, the hooking members 20 of the invention have similar, uniform dimensions, and all of the slots 38 in the face portions 30*a*, 32*a*, 34*a*, and 36*a* have similar, uniform dimensions, so that any hooking member 20 may be inserted into, and engaged with, any one of these slots 38. When in use, the hooking members 20 function to draw into contact the face portions 30*a* and 36*a*, and the face portions 32*a* and 34*a*, of the respective semi-circular portions 10 and 12, and to maintain this contact during the life of the column cover 14, as will be further described below.

An example of the manner in which a hooking member 20 of the invention is engaged with slots 38 of semi-circular section 12 will now be described. In this example, it is assumed that the face portions 32*a*, 30*a*, and 34*a*, 36*a* of the semi-circular sections 10 and 12, respectively, each have a thickness of (T) (e.g., 1/16"), and that the hooking member 20 is constructed such that 1) the length (L1) of the support surface 20*h* of the hooking member 20 is equivalent to twice this thickness (T) (plus design tolerances), and 2) the length (L3) of surface portion 20*q* of the hooking member 20 is equivalent to this thickness (T) (plus design tolerances).

Figure 4:
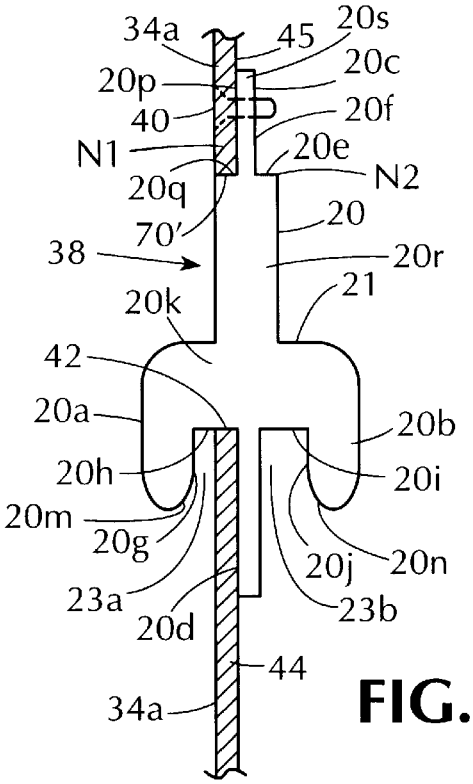
FIG. 4 shows the hooking member of FIGS. 3*a* and 3*b* in engagement with a segment of a semi-circular section of the column cover assembly of FIG. 1.

Referring to FIG. 4, the first panel engaging portion 20*a*, part of the lower head portion 20*r*, and part of the base portion 20*k* of the hooking member 20, are inserted into a slot 38 of face portion 34*a*, and the hooking member 20 is then lowered until it engages the face portion 34*a* in the manner depicted. As a result, the support surface 20*h* of the hooking member 20 rests on inner surface 42 of the face portion 34*a*, the panel engaging tail portion 20*d* of the hooking member 20 abuts a surface 44 of the face portion 34*a*, and a segment of the face portion 34*a* above the slot 38 is received within the notch (N1) such that surfaces 70' and 45 of the face portion 34*a* abut the surfaces 20*q* and 20*p*, respectively, of the hooking member 20. In this manner, the hooking member 20 is fitted into the slot 38. The hooking member 20 may also be fastened to the face portion 34*a* using any suitable fastening mechanism, such as, for example, a rivet or screw 40 or an adhesive. Other hooking members 20 are then fitted into other corresponding slots 38 of the face portion 34*a*, and into corresponding slots 38 of the face portion 36*a*, in a similar manner as described above. Thereafter, the semi-circular section 12 may be coupled to the semi-circular section 10 by means of the hooking members 20. It should be noted that for each face portion 30*a*, 32*a*, 34*a*, and 36*a*, the number of slots 38 having hooking members 20 engaged therein may be less than the total number of slots 38 in the face portion, so long as the number of hooking members 20 employed is sufficient to enable the semi-circular sections 10 and 12 to be adequately secured to one another.

The manner in which the semi-circular sections 10 and 12 are coupled together will now be described. It is assumed that the semi-circular sections 10 and 12 are positioned on opposite sides of the structural column 16, and that the semi-circular section 10 is mounted in place in the manner described above. The semi-circular section 12 is then raised slightly (e.g., in a vertical direction by approximately ½") and is brought towards the semi-circular section 10 in such a manner that enables the engaging portion 20*a* and part of the base portion 20*k* of the individual hooking members 20 to be inserted into a corresponding slot 38 of the semi-circular portion 10, and to cause the face portions 34*a* and 36*a* of the semi-circular section 12 to be in contact with the respective face portions 32*a* and 30*a* of the semi-circular section 10. The semi-circular section 12 is then lowered for causing the hooking members 20 to become lockingly engaged with the semi-circular section 10, as facilitated by the rounded edge 20*m* of the hooking members 20, and to thereby cause the two semi-circular sections 10 and 12 to be drawn together and fixedly coupled so as to form the column cover 14.

An example of the manner in which an individual hooking member 20 fixedly couples semi-circular sections 10 and 12 is represented in FIG. 5. In FIG. 5, hooking member 20 is shown as being engaged with the face portions 30*a* and 36*a* of the respective semi-circular sections 10 and 12. As can be seen, in addition to the support surface 20*h* of the hooking member 20 resting on the inner surface 42 of face portion 36*a*, the panel engaging tail portion 20*d* abutting a rear surface 44 of the face portion 36*a*, and surfaces 20*q* and 20*p* of the hooking member 20 abutting surfaces 70' and 45, respectively, of the face portion 36*a*, the support surface 20*h* of hooking member 20 also rests on an inner surface 46 of the face portion 30*a*, and the locking surface 20*g* of the hooking member 20 abuts a rear surface 48 of face portion 30*a*. In this configuration, the hooking member 20 maintains the face portions 30*a* and 36*a* in abutting engagement. Other hooking members 20 similarly operate for drawing together in abutting engagement the face portions 30*a* and 36*a* of the respective semi-circular sections 10 and 12, and also for drawing together in abutting engagement the face portions 32*a* and 34*a* of the respective semi-circular sections 10 and 12. In this manner, the hooking members 20 fixedly coupled the semi-circular sections 10 and 12 together, thereby forming the column cover 14 around the structural column 16, as is represented in FIGS. 2.

Another aspect of this invention will now be described. As was previously mentioned, the hooking members 20 are adapted for receiving panel segments having different thicknesses. For example, panel segments having a first thickness can be received in the first gap 23*a* between the locking surface 20*g* and the panel engaging tail portion 20*d* of the hooking member 20, and panel segments having a second, greater thickness can be received in the second gap 23*b* between the locking surface 20*j* and the panel engaging tail portion 20*d* of the hooking member 20. Having already described an exemplary case wherein panel segments are received in the first gap 23*a* (see, e.g., FIG. 5), an example in which panel segments having a greater thickness are received in the second gap 23*b* will now be described. In this example, it is assumed that the face portions 32*a,* 30*a,* and 34*a,* 36*a* of the semi-circular sections 10 and 12, respectively, each have a thickness of (T1) (e.g., ⅛"), and that the hooking members 20 are constructed such that 1) the length (L2) of the support surface 20*i* of the hooking members 20 is equivalent to twice this thickness (T1) (plus design tolerances), and 2) the length (L4) of surface portion 20*e* of the hooking member 20 is equivalent to the thickness (T1) (plus design tolerances).

Figure 7:
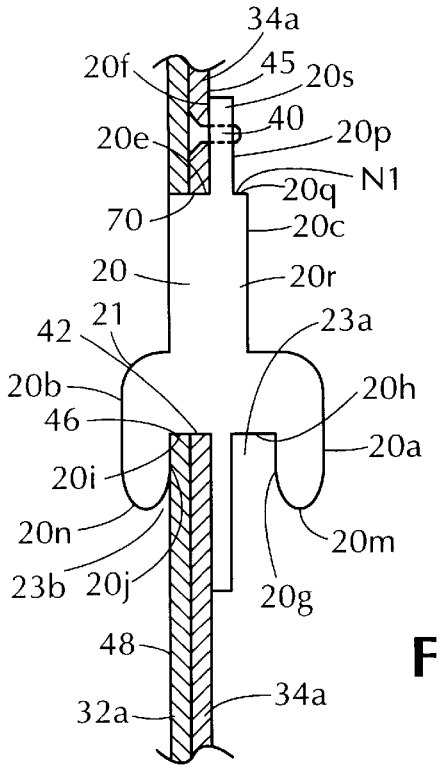
FIG. 7 shows the hooking member of FIG. 3*a,* after having been rotated 180 degrees about a vertical axis, and after being engaged with segments of semi-circular sections of the column cover assembly of FIG. 1.

Referring to FIG. 7, the hooking member 20 of FIG. 3*a* is shown, after having been rotated about a vertical axis by 180 degrees. Having the attitude represented in FIG. 7, the hooking member 20 can be engaged with the face portion 34*a* of semi-circular section 12 in a similar manner as was described above, except that in this case, the support surface 20*i* of the hooking member 20, rather than the support surface 20*h,* rests on the inner surface 42 of the face portion 34*a.* Also, a segment of the face portion 34*a* above the slot 38 is received within the notch (N2) such that the surface 20*f* abuts surface 45 of the face portion 34*a,* and surface 20*e* abuts surface 70 of the face portion 34*a.* The hooking member 20 may be secured in place using any suitable securing mechanism, such as, for example, a rivet or screw 40 or an adhesive. Also, for joining the semi-circular sections 10 and 12 together, the hooking member 20 may be engaged with a face portion 32*a* of semi-circular section 10 in a similar manner as was described above. In this case, however, the support surface 20*i* of the hooking member 20 also rests on inner surface 46 of the face portion 32*a,* and inner surface 20*j* of the hooking member 20 abuts surface 48 of face portion 32*a,* as depicted in FIG. 7. As such, it can be appreciated that the hooking members 20 of the invention may be employed for joining semi-circular sections 10 and 12 together, regardless of whether the face portions have a thickness of (T) or (T1).

Figure 8:
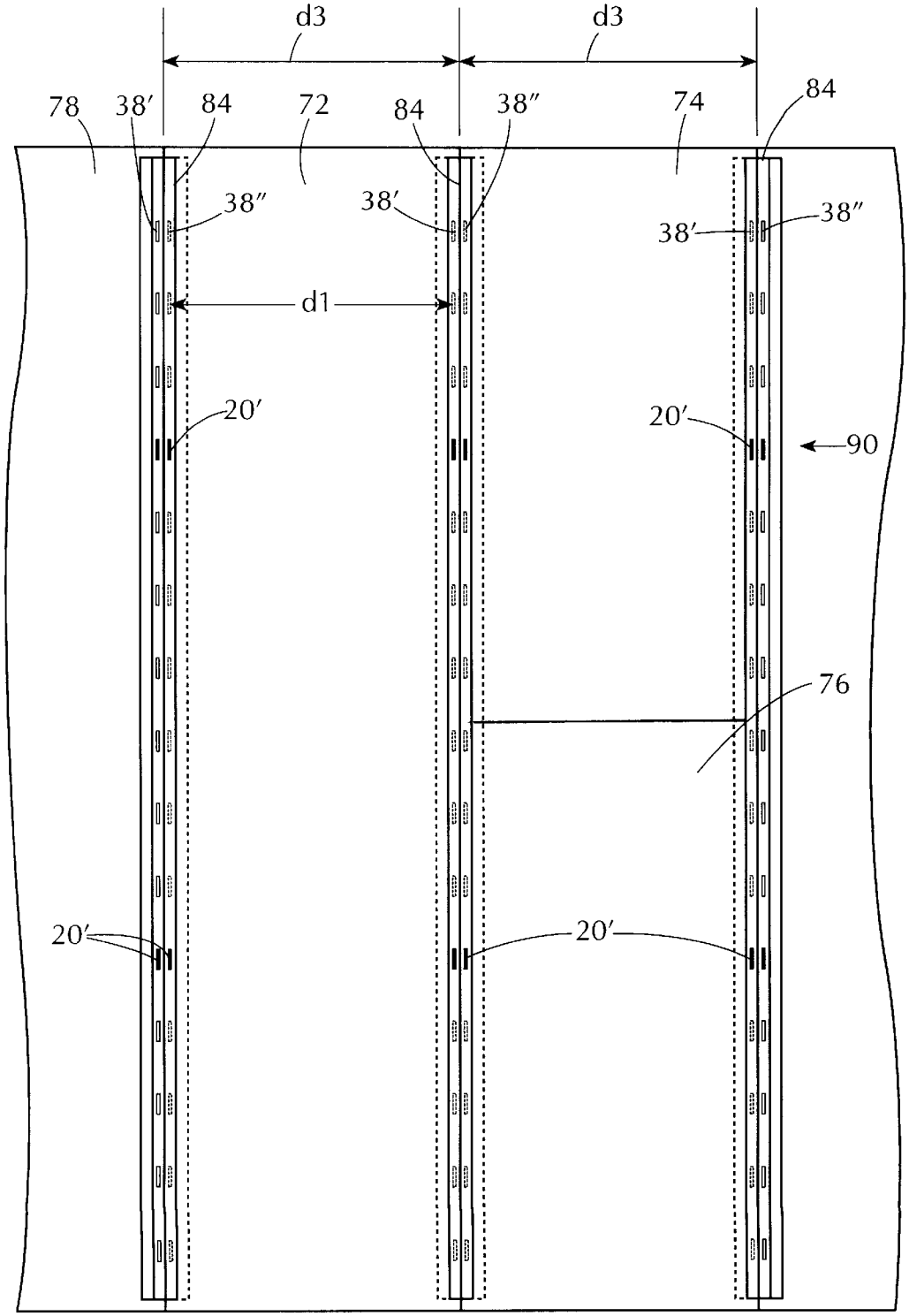
FIG. 8 shows a wall panel assembly constructed in accordance with an embodiment of this invention.

Having described various embodiments of the invention relating to a column cover assembly 14, a further aspect of this invention will now be described. In accordance with this aspect of the invention, a wall panel assembly 90 is provided, as shown in FIG. 8. In one embodiment of the invention, the wall panel assembly 90 comprises one or more wall panels, such as a first wall panel 72, a second wall panel 74, a third wall panel 76, and a fourth wall panel 78, and further comprises a plurality of wall panel supporting members 84. The number of wall panels and wall panel supporting members employed may vary, depending on applicable design criteria.

Figure 10:
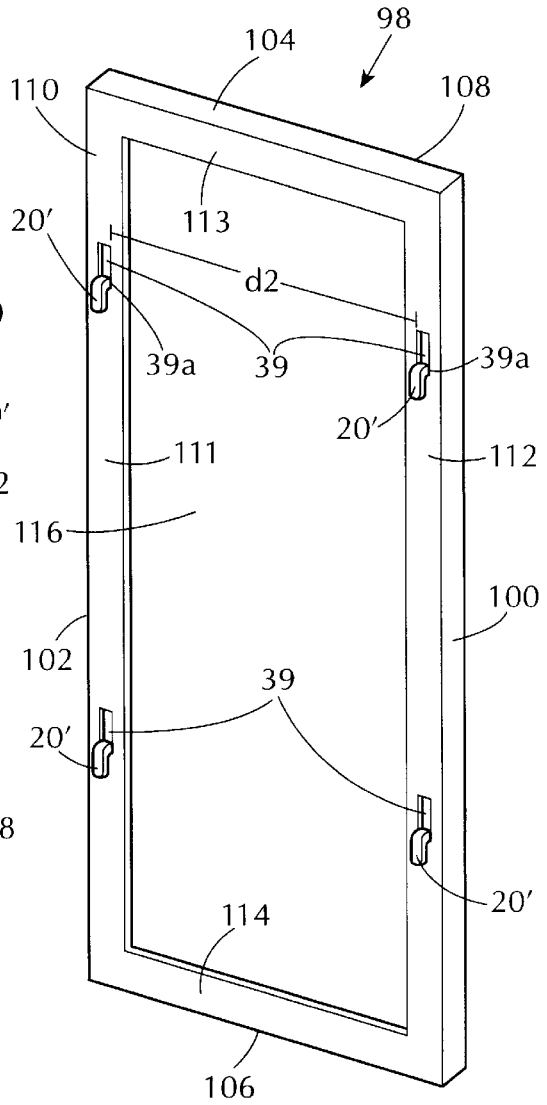
FIG. 10 is a perspective view of one of the wall panels of FIG. 9, as viewed from a perspective looking at a rear and sides of the wall panel.

Referring also to FIG. 10, a wall panel 98 that is constructed in accordance with a preferred embodiment of the invention is shown. The wall panel 98 represents, for example, any of the wall panels 72, 74, 76, and 78 of the wall panel assembly 90 of FIG. 8. The width, thickness, and length of the wall panel 98 may be selected in accordance with applicable design criteria. For example, the length of the wall panel 98 may be equivalent to floor-to-ceiling spacings standard within the construction field (e.g., 8 feet), or may be equivalent to one half of these spacings (e.g., 4 feet). In a preferred embodiment of the invention, the wall panel 98 comprises upper and lower walls 104 and 106, respectively, first and second side walls 100 and 102, respectively, a front wall 108, and a rear, abbreviated wall 110, which is formed from flanges 111, 112, 113, and 114 extending from respective margins of a rear portion of the wall panel 98.

A plurality of longitudinally aligned slots 39 are provided at predetermined longitudinal intervals in flanges 111 and 112. The number of slots 39 provided in each flange 111 and 112 may be determined in accordance with applicable design criteria, but is preferably great enough for enabling a sufficient number of hooking members 20' to be employed for adequately securing the wall panel 98 to the supporting members 84. Also, the distance separating adjacent, longitudinally aligned slots 39 of the individual flanges 111 and 112, is preferably the same as, or a predetermined multiple of, the distance separating adjacent, longitudinally aligned slots (referred to below) of the supporting members 84.

Figure 11:
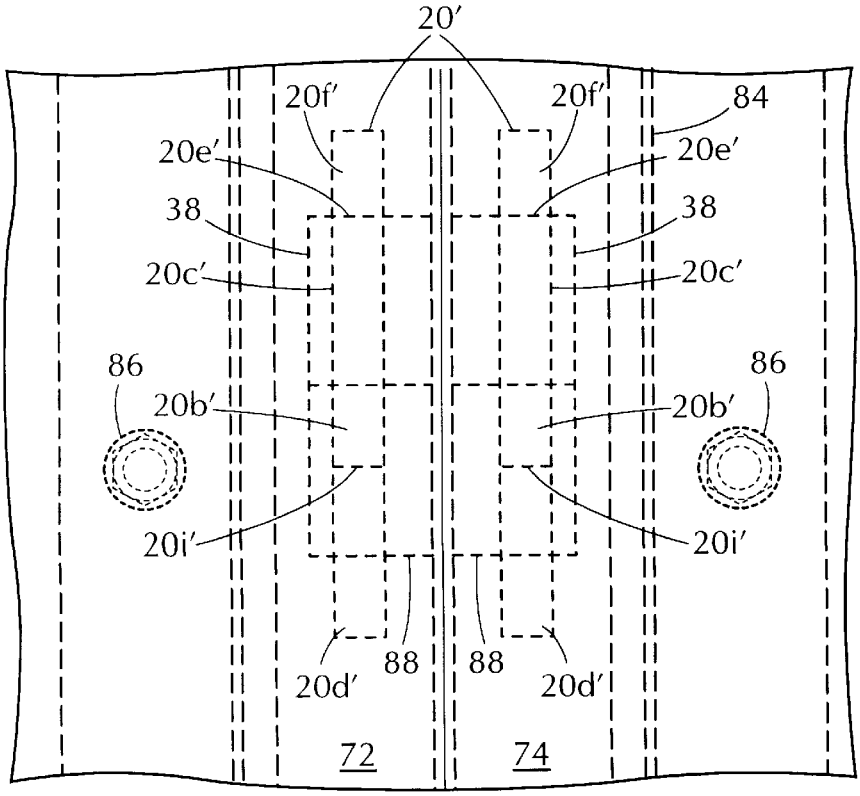
FIG. 11 shows a portion of the wall panel assembly of FIG. 8.

Hooking members 20' are engaged with the wall panel in a similar manner as was described above (see, e.g., FIG. 4), with the hooking members 20' each having an attitude determined by the thicknesses of the flanges 111 and 112 and supporting members 84. In accordance with one embodiment of the invention, a shim or wedge block 88 is provided between each hooking member 20' and a rear surface 116 of the front wall 108 of the wall panel, for securing the hooking members 20' in place (see, e.g., FIGS. 11 and 12), although other suitable securing mechanisms may also be employed. The wedge block 88 may comprise any suitable rigid material, such as, for example, neoprene or EPDM.

Figure 9:
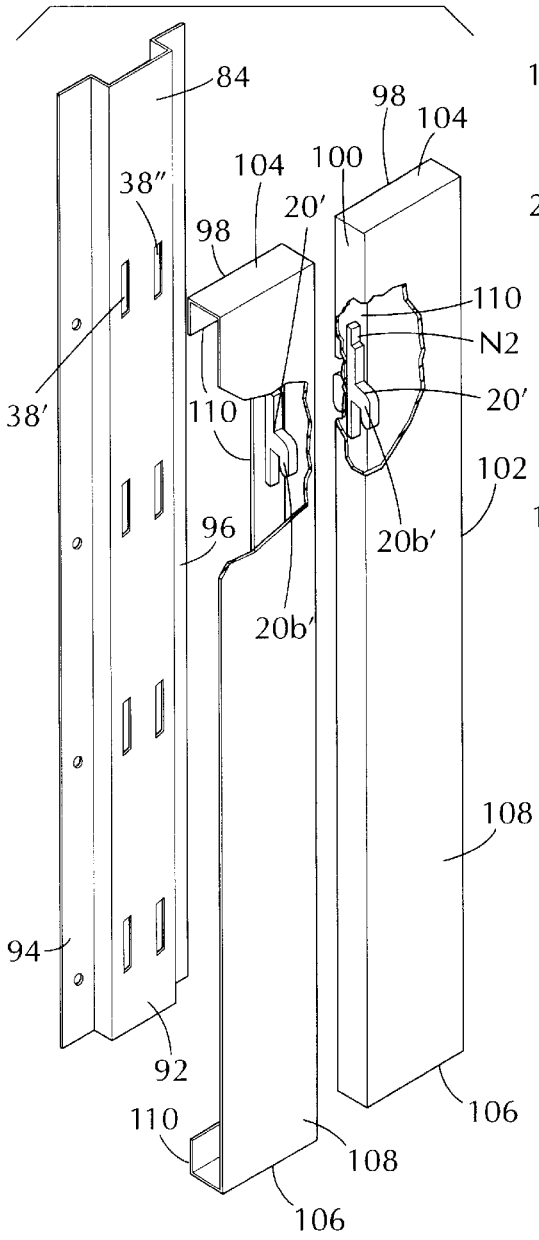
FIG. 9 is a perspective view of a wall panel assembly of this invention, wherein wall panel components of the wall panel assembly are depicted as being disassembled from a supporting member of the wall panel assembly.

Referring now to FIG. 9, each wall panel supporting member 84 is substantially U-shaped, and has a base portion 92 and flanges 94 and 96, which may be formed by double right angle bends in opposing longitudinal edges of the supporting member 84. A plurality of transversely aligned slot pairs made up of slots 38' and 38" are provided at predetermined longitudinal intervals in the base portion 92. The transverse spacing between the slots 38' and 38" preferably equals twice the distance separating an outer margin of the wall panel 98 and a hooking member 20' engaged with the wall panel 98, for enabling wall panels 98 mounted in adjacent ones of these slots to be marginally abutted, although in other embodiments, other selected spacings between slots 38' and 38" may be employed.

Figure 12:
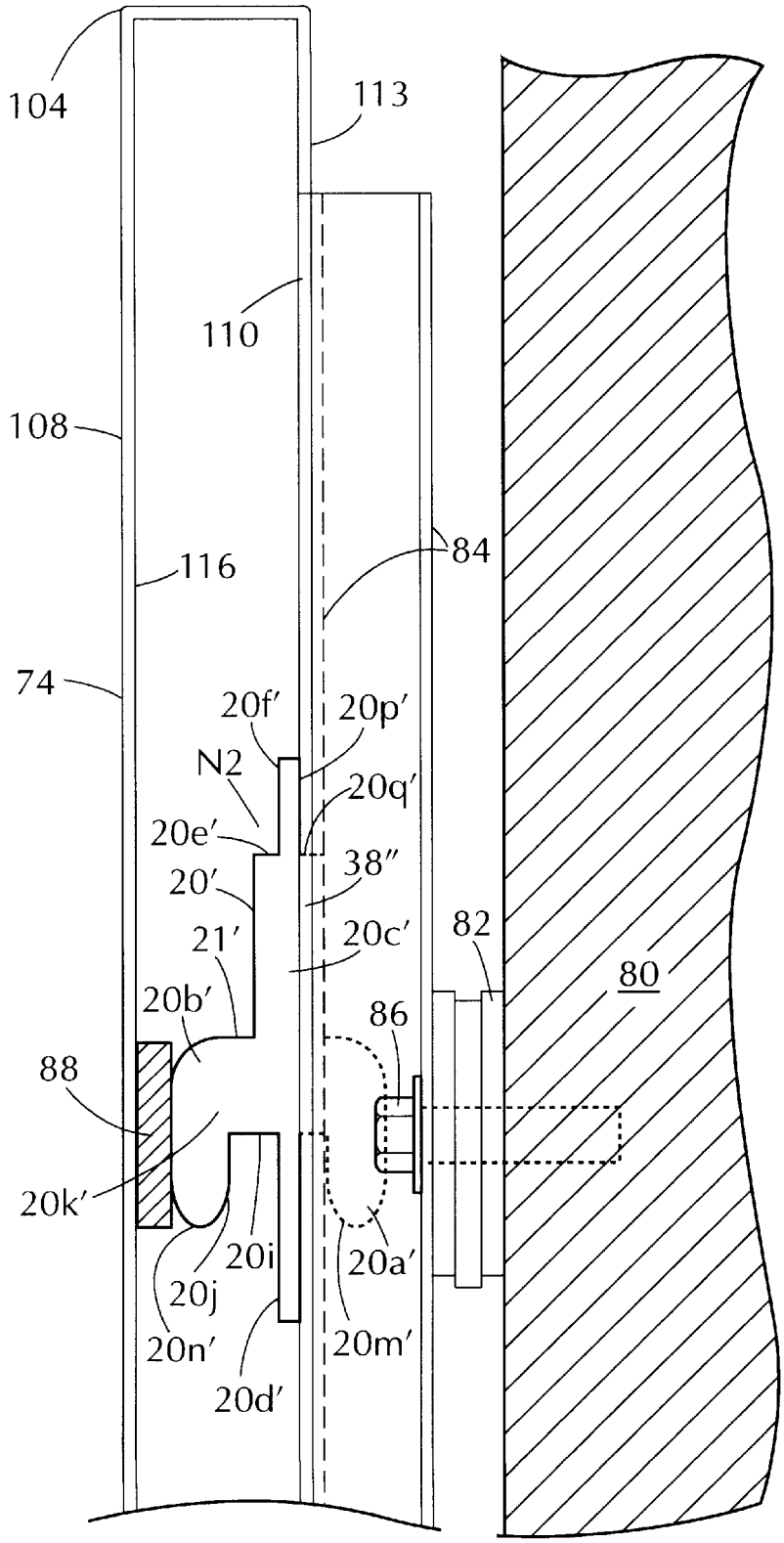
FIG. 12 shows a portion of the wall panel assembly of FIG. 8, as viewed from a perspective looking at a side of the wall panel assembly.

As can be appreciated in view of FIG. 12, the supporting members 84 are mounted to a fixed structure 80, such as a building wall or column, using any suitable mounting mechanism, such as, for example, screws 86. Also, depending on applicable design criteria, shims 82 may be employed between the structure 80 and the supporting members 84. Preferably, and referring also to FIG. 8, the supporting members 84 are separated from one another such that 1) a distance (d1) (FIG. 8) separating the slots 38' and 38" of adjacent ones of the supporting members 84 is substantially equivalent to a distance (d2) (FIG. 10) separating corresponding slots 39 of the flanges 111 and 112, and 2) a distance (d3) between center axes of the adjacent supporting members 84 is substantially equivalent to the width of the individual wall panels 98.

In order to mount the wall panel 98 to the supporting members 84, the wall panel 98 is raised slightly and is brought towards the supporting members 84 in such a manner that enables the panel engaging portion 20*a*' and part of the base portion 20*k* of the hooking members 20' to be inserted into corresponding slots 38', 38" of adjacent supporting members 84. The wall panel 98 is then lowered for causing the panel engaging portion 20*a*' of the hooking members 20' to become engaged with these supporting members 84 in the manner described above. As a result, the rear, abbreviated wall 110 of the wall panel 98 is drawn into abutting engagement with front surfaces of the supporting members 84, and the wall panel 98 becomes supported/suspended in place by the supporting members 84, acting in conjunction with the hooking members 20' (see, e.g., FIG. 12). In this manner, the wall panel assembly of the invention is constructed.

The above described embodiments of the column cover assembly and wall panel assembly of the invention provide a number of advantages. For example, both the column cover assembly and wall panel assembly are relatively easy to install, and thus reduce field installation costs. Also, standardized manufacturing techniques may be employed for fabricating components of these assemblies, thereby enabling manufacturing costs to be reduced. Furthermore, the components of these assemblies can be disassembled and re-assembled efficiently, and without great difficultly. This is beneficial in cases in which, for example, it is necessary to access, repair and/or replace various ones of the components.

Thus, it is apparent that there has been provided in accordance with the present invention, self-aligning architectural column cover and wall panel assemblies that fully satisfy the objects, aims, and advantages set forth above. While the invention has been particularly shown and described with respect to preferred embodiments thereof, it will be understood by those skilled in the art that changes in form and details may be made therein without departing from the scope and spirit of the invention. For example, although the column cover assembly of the invention is described in the context of employing semi-circular shaped sections 10 and 12 for forming the circular shaped column cover 14, the sections 10 and 12 need not be semi-circular in shape. For example, two or more curved sections which each form other portions of a circle may also be employed, so that when these sections are joined together, they collectively form the circular column cover. Also, sections having other desired shapes may also be employed to form column covers having other desired shapes (e.g., square, oval, elliptical, rectangular, etc.).

What is claimed is:

1. An architectural assembly, comprising:

a plurality of curved panels, each having a respective surface that includes at least one slot therein; and at least one hooking member, each being engaged with corresponding slots in respective, opposing surfaces of at least two of said panels, for fixedly coupling those panels.

2. An architectural assembly as set forth in claim 1, wherein each panel is semi-circular in shape.

3. An architectural assembly as set forth in claim 1, wherein the surface of each panel is formed by a longitudinal edge of the panel, and each hooking member fixedly couples corresponding longitudinal edges of at least two of the panels so that those panels collectively form a substantially circular structure.

4. An architectural assembly as set forth in claim 1, wherein each of said panels surrounds a respective portion of a structural column.

5. An architectural assembly as set forth in claim 1, wherein there are a plurality of said hooking members, the surface of each panel is formed by a longitudinal edge of the panel, each longitudinal edge has a plurality of slots therein, and wherein said hooking members are lockingly engaged with corresponding slots of said panels.

6. An architectural assembly as set forth in claim 5, wherein the plurality of slots of individual ones of the longitudinal edges are longitudinally aligned.

7. An architectural assembly as set forth in claim 1, wherein each hooking member comprises:

a substantially U-shaped portion, said U-shaped portion including a base portion and first and second projecting portions extending from a first surface of said base portion;

a head portion extending from a second, opposite surface of said base portion; and a tail portion extending from the first surface of said base portion and being disposed between said first and second projecting portions, wherein while said hooking member is engaged with the corresponding slots in the respective, opposing surfaces of the at least two panels, said head and tail portions abut at least one of those surfaces, and at least a portion of each of those surfaces is disposed within one of a first gap provided between said first projecting portion and said tail portion and a second gap provided between said second projecting portion and said tail portion.

8. An architectural assembly as set forth in claim 1, wherein each of the surfaces has a plurality of slots therein, and wherein said hooking members and said slots are constructed such that any one of said hooking members can be fitted into any of said slots.

9. An architectural assembly as set forth in claim 8, wherein the slots are identical in shape.

10. An architectural assembly, comprising:

a plurality panels; and a plurality of hooking members, said plurality of hooking members being in locked engagement with corresponding edges of said panels, for fixedly coupling together said panels, wherein each of said hooking members comprises:

a base portion, at least a portion of said base portion residing in a respective slot formed in at least one of said panels;

at least one projecting portion extending downwardly from said base portion;

a head portion extending from an upper surface of said base portion, said head portion abutting one of said panels; and a tail portion extending from a lower surface of said base portion, and wherein said at least one projecting portion and said tail portion receive respective portions of the edges of two of said panels therebetween, for fixedly coupling these portions.

11. An architectural assembly as set forth in claim 10, wherein said at least one projecting portion includes a first projecting portion and a second projecting portion, said first and second projecting portions extend downwardly from opposing sides of said base portion, said first projecting portion is separated from said tail portion by a first gap, said second projecting portion is separated from said tail portion by a second gap, and wherein respective portions of the edges of said two panels are fixedly coupled together within one of said first gap and said second gap of said hooking members.

12. A panel attachment assembly, comprising:

a plurality of supporting members mounted to a fixed structure, each supporting member having at least one slot therein;

at least one panel, each having at least one slot therein; and at least one hooking member, each being engaged with a slot in said at least one panel and a slot in a respective one of said supporting members for fixedly securing said at least one panel to the respective supporting member.

13. A panel attachment assembly as set forth in claim 12, wherein the at least one hooking member includes a plurality of hooking members, each of said supporting members and said at least one panel has a plurality of slots therein, the slots of each supporting member being aligned with at least some of the slots of said at least one panel, and wherein said hooking members engage the slots of said at least one panel and said supporting members.

14. A panel attachment assembly as set forth in claim 12, wherein each hooking member comprises:

a substantially U-shaped portion, said U-shaped portion including a base portion and first and second projecting portions extending from a first surface of said base portion;

a head portion extending from a second, opposite surface of said base portion; and a tail portion extending from the first surface of said base portion and being disposed between said first and second projecting portions, wherein while said hooking member is engaged with the slot in the at least one panel and the slot in the respective one of the supporting members, said head and tail portions abut a surface of one of the at least one panel and the respective supporting member, and at least a portion of each of the at least one panel and the respective supporting member is disposed within either a first gap provided between said first projecting portion and said tail portion or a second gap provided between said second projecting portion and said tail portion.

15. A panel attachment assembly as set forth in claim 12, wherein the at least one slot of said at least one panel and the at least one slot of each supporting member are identical in shape.

16. A panel attachment assembly, comprising:

a plurality of supporting members mounted to a fixed structure;

at least one panel; and a plurality of hooking members, said plurality of hooking members being in locking engagement with said at least one panel and said supporting members for fixedly securing said at least one panel to said supporting members, wherein each of said hooking members comprises:

a base portion, at least a portion of said base portion residing in a respective slot formed in said at least one panel and one of said supporting members;

at least one projecting portion extending downwardly from said base portion;

a head portion extending from an upper surface of said base portion, said head portion abutting said at least one panel; and a tail portion extending from a lower surface of said base portion, wherein said at least one projecting portion and said tail portion receive therebetween a respective portion of said at least one panel and a respective portion of one of said supporting members.

17. A panel attachment assembly as set forth in claim 16, wherein said at least one projecting portion includes a first projecting portion and a second projecting portion, said first and second projecting portions extend downwardly from opposing sides of said base portion, said first projecting portion is separated from said tail portion by a first gap, said second projecting portion is separated from said tail portion by a second gap, and wherein said respective portion of said at least one panel and said respective portion of one of said supporting members are in locked engagement within one of said first gap and said second gap of said hooking members.

18. A panel attachment assembly as set forth in claim 16, wherein each of said supporting members and said at least one panel has a plurality of slots therein, and wherein said hooking members and said slots are constructed such that any one of said hooking members can be fitted into any of said slots.

19. A panel attachment assembly as set forth in claim 18, wherein the slots of said at least one panel and the slots of each supporting member are identical in shape.

20. A hooking apparatus, comprising:

an inverted U-shaped portion, said U-shaped portion including a base portion and first and second projecting portions, said first projecting portion extending downwardly from a first side of said base portion, said second projecting portion extending downwardly from a second, opposite side of said base portion;

a head portion extending from an upper surface of said base portion; and a tail portion extending from a lower surface of said base portion and being disposed between said first and second projecting portions, wherein a first gap separates said first projecting portion and said tail portion, and a second gap separates said second projecting portion and said tail portion;

wherein said hooking member is for being engaged with external structures such that at least a portion of said base portion resides in at least one slot formed in the external structures, said head and tail portions abut at least one of the external structures, and respective portions of the external structures are in locked engagement within either said first gap between said first projecting portion and said tail portion or within said second gap between said second projecting portion and said tail portion, said hooking member thereby maintaining the external structures in fixed engagement.

21. A hooking apparatus as set forth in claim 20, wherein a lower surface of said base portion and an inner surface of said first projecting portion form a right angle, and the lower surface of said base portion and an inner surface of said second projecting portion form a right angle.

22. A hooking apparatus as set forth in claim 20, wherein said head portion includes an upper head portion and a lower head portion, said lower head portion extends upwardly from the upper surface of said base portion, said upper head portion extends upwardly from an upper surface of said lower head portion, and wherein said upper head portion has a narrower width than said lower head portion.

23. A hooking apparatus as set forth in claim 22, wherein an outer surface of portions of said upper and lower head portions defines at least one angled notch for abutting a corresponding angled segment of one of the external structures, wherein the angled segment of the external structure is disposed above one of the slots of the external structure.

24. A hooking apparatus as set forth in claim 20, wherein said first gap is for receiving, between said first projecting portion and said tail portion, portions of the external structures having a first thickness, and said second gap is for receiving, between said second projecting portion and said tail portion, portions of the external structures having a second thickness.

25. A hooking apparatus as set forth in claim 20, wherein the external structures include panel segments.

* * * * *